US007975782B2

(12) United States Patent
Peterson

(10) Patent No.: US 7,975,782 B2
(45) Date of Patent: Jul. 12, 2011

(54) EARTH BIT HAVING A PRESSURE RELIEF VALVE

(75) Inventor: Gregory W. Peterson, Fort Worth, TX (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 0 days.

(21) Appl. No.: 11/840,958

(22) Filed: Aug. 18, 2007

(65) Prior Publication Data

US 2008/0041630 A1 Feb. 21, 2008

Related U.S. Application Data

(60) Provisional application No. 60/822,887, filed on Aug. 18, 2006.

(51) Int. Cl.
*E21B 10/24* (2006.01)

(52) U.S. Cl. ..... 175/227; 175/228

(58) Field of Classification Search ..... 175/228, 175/227, 229, 337; 137/843, 844, 849, 856, 137/859, 228
See application file for complete search history.

(56) References Cited

U.S. PATENT DOCUMENTS

| | | | | |
|---|---|---|---|---|
| 1,865,764 | A * | 7/1932 | Keenan | 215/260 |
| 3,550,972 | A | 12/1970 | Coski | |
| 3,847,234 | A | 11/1974 | Schumacher, Jr. et al. | |
| 3,847,235 | A | 11/1974 | Goodfellow | |
| 3,942,596 | A | 3/1976 | Millsapps, Jr. | |
| 4,040,493 | A | 8/1977 | Saxman | |
| 4,125,127 | A * | 11/1978 | Harter | 137/494 |
| 4,136,748 | A | 1/1979 | Dickerhoff | |
| 4,303,137 | A | 12/1981 | Fischer | |
| 4,427,307 | A | 1/1984 | Norlander et al. | |
| 4,453,836 | A | 6/1984 | Klima | |
| 4,627,882 | A | 12/1986 | Soderstrom | |
| 4,688,651 | A | 8/1987 | Dysart | |
| 4,741,471 | A | 5/1988 | Sullivan | |
| 4,781,770 | A | 11/1988 | Kar | |
| 4,887,675 | A | 12/1989 | Shotwell | |
| 4,942,930 | A * | 7/1990 | Millsapps, Jr. | 175/220 |
| 5,072,795 | A | 12/1991 | Delgado et al. | |
| 5,453,097 | A * | 9/1995 | Paradis | 604/247 |
| 6,092,611 | A | 7/2000 | Saxman | |
| 6,202,766 | B1 | 3/2001 | Shepherd | |
| 6,206,110 | B1 * | 3/2001 | Slaughter et al. | 175/57 |
| 6,513,607 | B2 | 2/2003 | Peterson et al. | |
| 6,769,500 | B2 | 8/2004 | Miglierini | |
| 6,789,634 | B1 | 9/2004 | Denton | |
| 6,802,380 | B2 | 10/2004 | Blackman | |
| 2010/0032039 | A1 * | 2/2010 | Nemoto et al. | 137/843 |

OTHER PUBLICATIONS

Dictionary definitions of "include," "dispose," "comprise," "contain," and "arrange", accessed Jan. 20, 2011 via www.thefreedictionary.com.*

* cited by examiner

*Primary Examiner* — David J Bagnell
*Assistant Examiner* — Blake Michener
(74) *Attorney, Agent, or Firm* — Schmeiser Olsen & Watts LLP

(57) ABSTRACT

An earth bit includes a cutting cone mounted to a lug to form a bearing cavity. A valve is in fluid communication with the bearing cavity and a bit chamber, wherein the valve includes a diaphragm with an aperture. The aperture is repeatably moveable between open and closed conditions in response to a pressure difference between the material in the bearing cavity and bit chamber.

51 Claims, 6 Drawing Sheets

EARTH BIT HAVING A PRESSURE RELIEF VALVE

CROSS-REFERENCE TO RELATED APPLICATIONS

This patent application claims priority to U.S. Provisional Application No. 60/822,887 filed in Aug. 18, 2006, the contents of which are incorporated herein by reference.

BACKGROUND OF THE INVENTION

1. Field of the Invention

This invention relates generally to earthboring tools for boring a hole.

2. Description of the Related Art

Earthboring tools are commonly used to bore holes by cutting through earthen annulus. Such holes may be bored for many different reasons, such as drilling for oil, minerals and water. One type of earthboring tool used for boring is a rotary earth bit. Several examples of rotary earth bits are disclosed in U.S. Pat. Nos. 3,550,972, 3,847,235, 4,136,748, 4,427,307, 4,688,651, 4,741,471 and 6,513,607. A rotary earth bit generally includes an earth bit body comprised of three lugs which form a bit chamber. A cutting cone is rotatably mounted to each lug with a bearing journal. The bearing journal generally includes a bearing system having ball and roller bearings which engage the cutting cone. The lug rotates in response to the rotation of the earth bit. The cutting cones are engaged with the roller and ball bearings and rotate, in response to contacting earthen annulus, about the bearing journal.

A lubricating material is often used to lubricate the bearing system. The lubricating material is retained in a bearing cavity in fluid communication with the bearing system. The lubricating material is typically retained within the bearing cavity by using one or more sealing members, such as O-ring seals. It should be noted that the lubricating material is generally a fluid or grease, but it can include vapors thereof.

The lubricating material experiences changes in temperature during the operation of the earth bit, which causes corresponding changes in its pressure in the bearing cavity. A force is applied to the sealing member(s) in response to the pressure of the lubricating material in the bearing cavity. The force stresses the sealing member(s), which can cause them to fail. Seal failure will cause premature bearing failure leading to early bit failure, so it is desirable to decrease the amount of force applied to it.

Earth bits often include a grease passage in fluid communication with the bearing cavity and the bit chamber. Heat is generated from friction in the bearing system. The grease passage allows pressure generated by this heat to equalize between the bearing cavity and bit chamber. However, it is desirable to control the pressure of the lubricating material.

BRIEF SUMMARY OF THE INVENTION

The present invention employs a valve for use with an earth bit, wherein the valve controls the pressure of a lubricating material in a bearing cavity. In one embodiment, the valve includes a diaphragm with an aperture, wherein the aperture is repeatably moveable between flexed and unflexed conditions in response to the pressure of the lubricating material in the bearing cavity. In the flexed condition, an aperture included with the diaphragm is open so the valve relieves the pressure of the lubricating material. In the unflexed condition, the aperture is closed so the valve does not relieve the pressure of the lubricating material. Hence, the aperture is moveable between open and closed conditions in response to the diaphragm flexing and unflexing. In this way, the valve controls the pressure of the lubricating material in the bearing cavity.

Further features and advantages of the invention will be apparent to those skilled in the art from the following detailed description, taken together with the accompanying drawings.

DETAILED DESCRIPTION OF THE INVENTION

Figure 1:
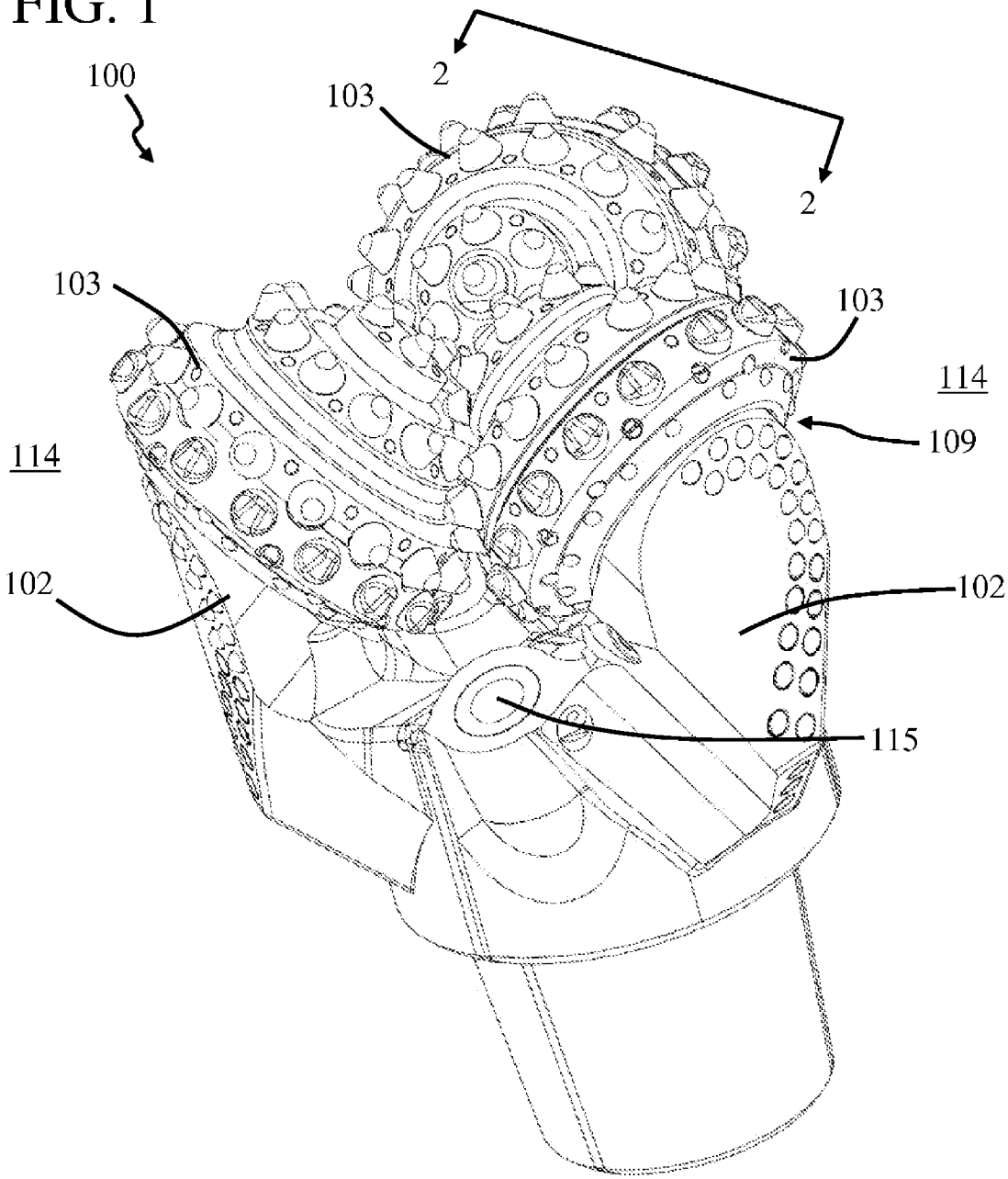
FIG. 1 is a perspective view of an earth bit having a valve, in accordance with the invention.
Figure 2:
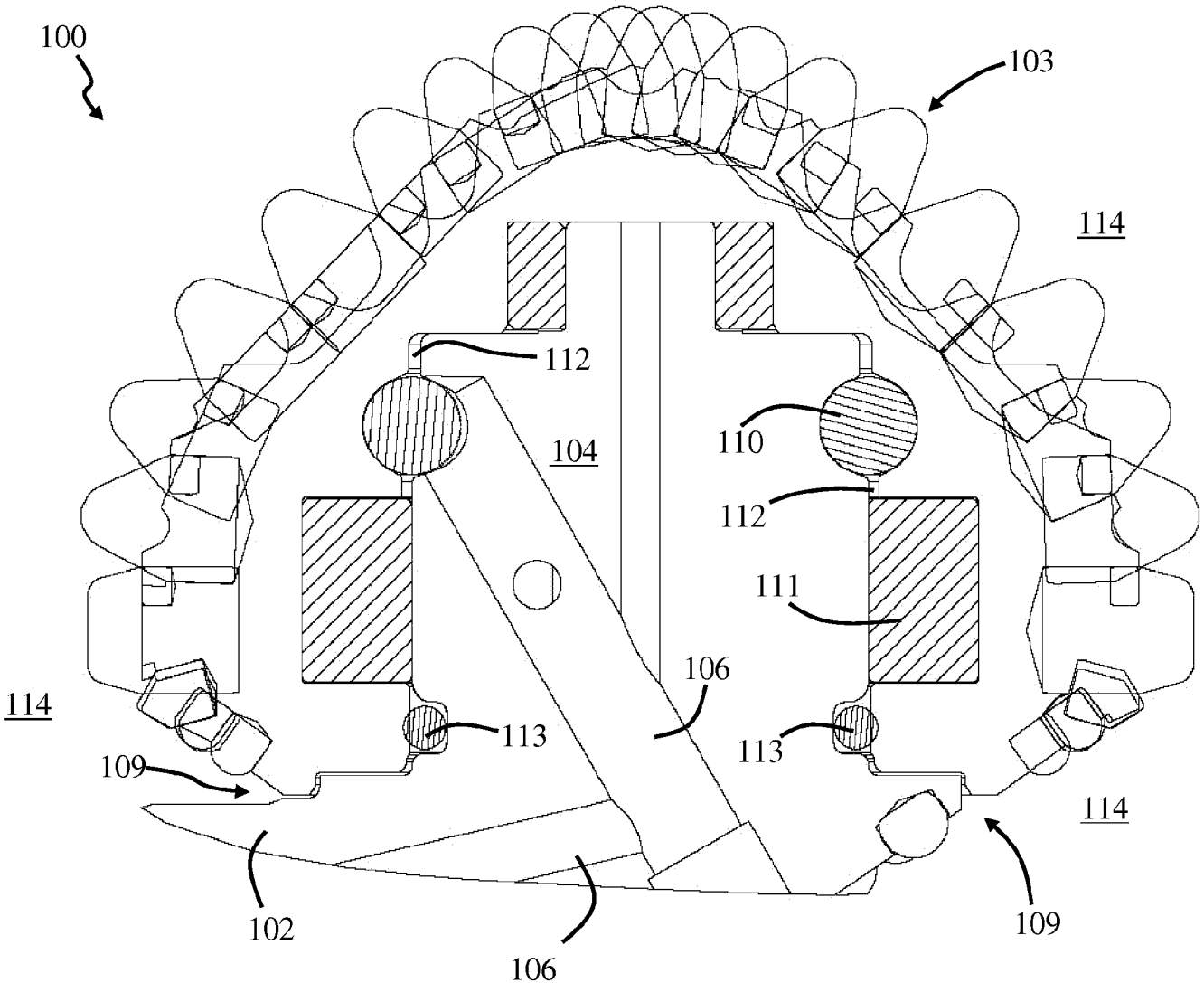
FIG. 2 is a cross-sectional view of the earth bit of FIG. 1 taken along a cut-line 2-2.

FIG. 1 is a perspective view of an earth bit 100 which includes a valve, in accordance with the invention. FIG. 2 is a cross-sectional view of earth bit 100 taken along a cut-line 2-2 of FIG. 1. As shown in FIGS. 1 and 2, earth bit 100 includes several earth bit components assembled together. In this embodiment, these components include three lugs 102 coupled to corresponding cutting cones 103. In this particular embodiment, earth bit 100 includes three cutting cones and corresponding lugs, so that earth bit 100 is a tri-cone earth bit. As shown in FIG. 2, cutting cone 103 is rotatably mounted to a corresponding lug 102 with a bearing journal 104. Bearing journal 104 includes roller and ball bearings 110 and 111, respectively, which rotatably engage cutting cone 103.

In this embodiment, earth bit 100 includes sealing member 113 (FIG. 2) positioned so that it seals between cutting cone 103 and bearing journal 104. Sealing member 113 retains a lubricating material in a valve cavity 108 (FIG. 3), a lubricant chamber 106 and a bearing cavity 112. Valve cavity 108 extends through valve 105 and is in fluid communication with cutting cone 103 and bearing journal 104, as well as roller and ball bearings 110 and 111. The lubricating material is used to lubricate cutting cone 103 and bearing journal 104, as well as roller and ball bearings 110 and 111, so the friction between them is reduced. Sealing member 113 restricts the flow of the lubricating material from bearing cavity 112 to an external region 114 of earth bit 100. Sealing member 113 restricts the flow of the lubricating material through an interface 109 between lug 102 and cutting cone 103.

The lubricating material can be of many different types, such as oil and grease. The lubricating material is generally in liquid form, but it can include vapors of the lubricating material. The amount of vapors in bearing cavity 112 typically depends on the pressure and temperature of the lubricating material.

In operation, lug 102 rotates in response to the rotation of earth bit 100. Cutting cone 103 is engaged with roller and ball bearings 110 and 111 and rotates, in response to contacting earthen annulus, about bearing journal 104. The lubricating material in bearing cavity 112 lubricates lug 102 and cutting cone 103, as well as roller and ball bearings 110 and 111, so that the friction between them is reduced.

As mentioned above, the lubricating material experiences changes in temperature during the operation of earth bit 100, which causes corresponding changes in its pressure in bearing cavity 112. A force is applied to sealing member 113 in response to the pressure of the lubricating material in bearing cavity 112. The force stresses sealing member 113, which can cause it to fail. Replacing an earth bit, or the components thereof, is costly and time consuming, so it is desirable to regulate the amount of force applied to sealing member 113.

When a sealing member fails, lubricating material flows from bearing cavity 112 to external region 114 of earth bit 100. The amount of friction between cutting cone 103, bearing journal 104 and roller and ball bearings 110 and 111 increases if there is not enough lubricating material in bearing cavity 112. Cutting cone 103, bearing journal 104 and roller and ball bearings 110 and 111 wear down faster as the amount of friction between them increases. Seal failure will cause premature bearing journal failure leading to early earth bit failure, so it is desirable to decrease the amount of friction between the components of bearing journal 104.

In this embodiment, earth bit 100 includes a lubricant chamber 106 (FIG. 2) in fluid communication with valve cavity 108. Lubricant chamber 106 allows heat to flow away from bearing cavity 112 and the lubricating material. This decreases the temperature of the lubricating material, as well as lug 102 and cutting cone 103. The lubricating material has a lower pressure since it has a lower temperature, so it applies a smaller force to sealing member 113. As will be discussed in more detail presently, another way to reduce the force applied to sealing member 113 is to relieve the pressure of the lubricating material in bearing cavity 112.

Figure 3:
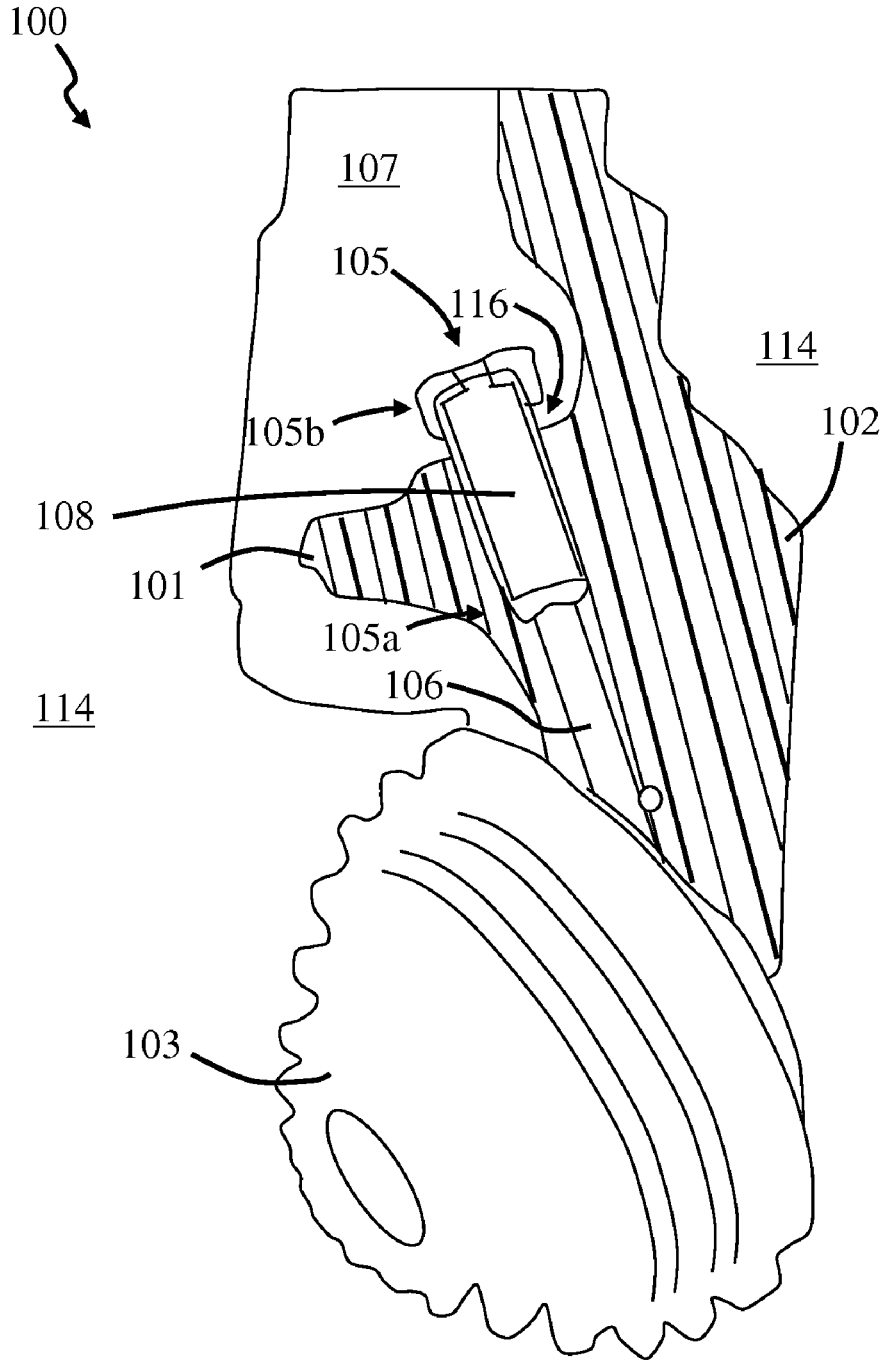
FIG. 3 is a cross-sectional view of a lug of the earth bit of FIG. 1 showing the valve.

FIG. 3 is a cross-sectional view of lug 102 of earth bit 100 which includes a valve 105, in accordance with the invention. In this embodiment, valve 105 has an input end 105a in fluid communication with bearing cavity 112 through lubricant chamber 106, and an output end 105*b* in fluid communication with a bit chamber 107. Valve cavity 108 extends between input and output ends 105*a* and 105*b*. Bit chamber 107 is enclosed within earth bit 100 and is in fluid communication with a nozzle 115 (FIG. 1). A drilling fluid, such as water and/or air, flows through bit chamber 107 and out nozzle 115 to spray material, such as earthen annulus, from cutting cone 103.

In this embodiment, valve 105 extends through lug 102. In particular, valve 105 extends through a shoulder 101 of lug 102. In this embodiment, valve 105 extends through a lubricant chamber opening 116 of lug 102. Lubricant chamber opening 116 extends through a shoulder 101 of lug 102. In this embodiment, input and output ends 105*a* and 105*b* of valve 105 are on opposed sides of shoulder 101. Input end 105*a* of valve 105 extends through lug 102. Input and output ends 105*a* and 105*b* of valve 105 are on opposed sides of lubricant chamber opening 116.

In accordance with the invention, valve 105 controls the flow of material through lubricant chamber 106. For example, it is desirable to restrict the drilling fluid from flowing through lubricant chamber 106 because it is undesirable to have the drilling fluid in grease. It is undesirable to have the drilling fluid in bearing cavity 112 because it is not as effective as the lubricating material at lubricating cutting cone 103, journal 104 and roller and ball bearings 110 and 111. Further, the drilling fluid often includes abrasive material, which can undesirably wear down sealing member 113, as well as cutting cone 103, bearing journal 104 and roller and ball bearings 110 and 111.

It is desirable to allow the lubricating material to flow through lubricant chamber 106 to relieve its pressure within bearing cavity 112. The pressure of the lubricating material is relieved so that it applies a smaller force on sealing member 113. Hence, in operation, valve 105 allows the flow of the lubricating material from input end 105*a* to output end 105*b* and restricts the flow of drilling fluid from output end 105*b* to input end 105*a*. Valve 105 allows the flow of lubricating material from input end 105*a* to output end 105*b* in response to the pressure of the lubricating material in bearing cavity 112 being greater than the pressure of the drilling fluid in lug chamber 107 by a threshold pressure value.

It should be noted that when valve 105 allows the flow of the lubricating material from input end 105*a* to output end 105*b*, the pressure of the lubricating material in bearing cavity 112 is driven to a lower pressure value. For example, in one situation, the pressure of the drilling fluid is driven to a pressure value wherein the difference between the pressure of the drilling fluid and the pressure of the drilling fluid is the threshold pressure value.

Valve 105 restricts the flow of the drilling fluid from output end 105*b* to input end 105*a*. In this way, valve 105 provides pressure relief for the lubricating material in valve cavity 108 and operates as a one-way valve. Valve 105 can operate as many different types of one-way valves, but in this embodiment, it operates as a one-way non-compensating pressure relief valve. A non-compensating valve does not vary the flow of material therethrough in response to changes in drilling fluid temperature and pressure. It should be noted, however, that in some embodiments, valve 105 can be replaced with a compensating pressure relief valve.

Figure 4A:
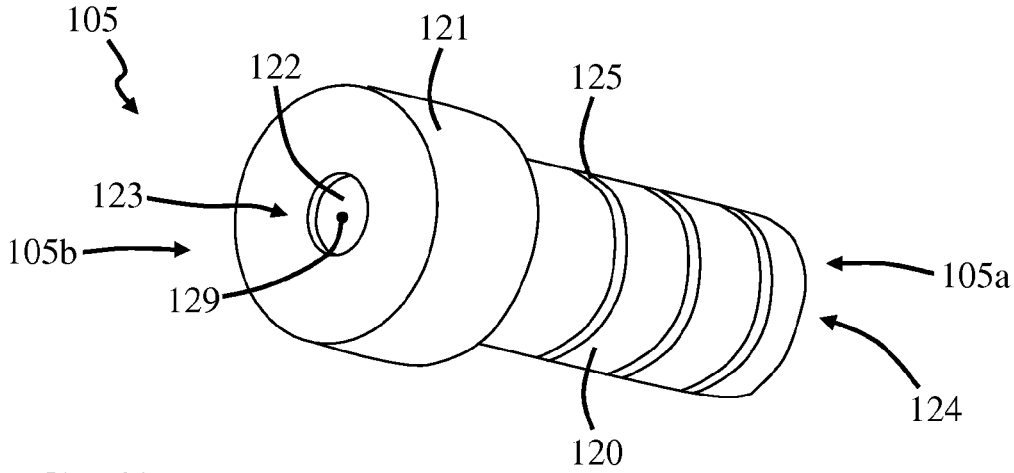
FIGS. 4*a* and 4*b* are perspective views of the output and input ends, respectively, of the valve of FIG. 3.
Figure 4B:
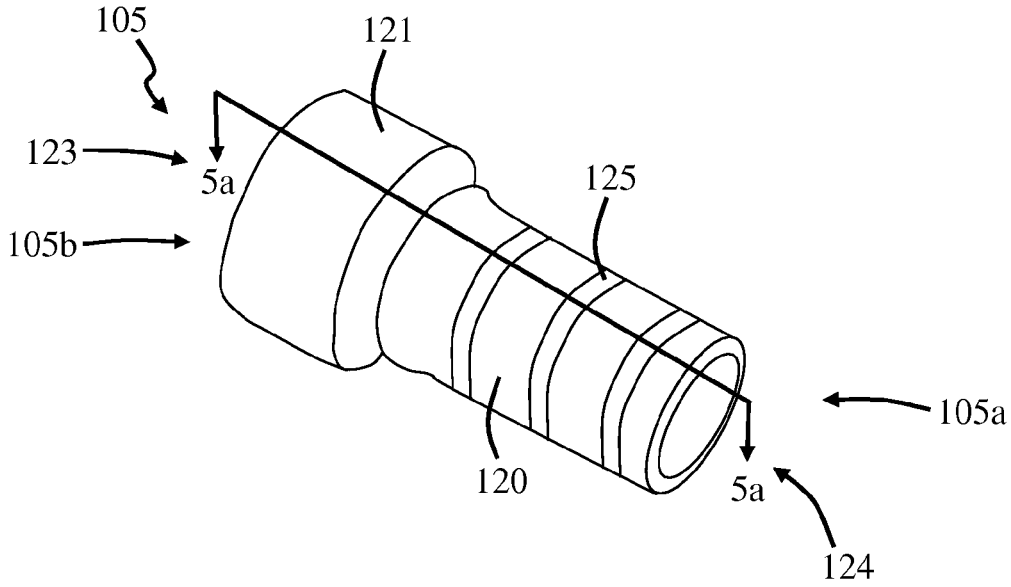
Figure 5A:
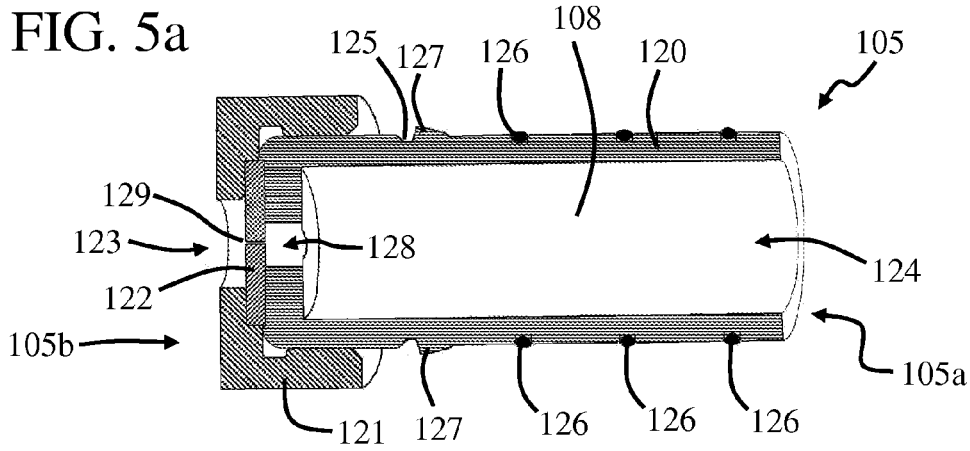
FIGS. 5*a*, 5*b* and 5*c* are cross-sectional view of the valve of FIG. 3 taken along a cut-line 5*a*-5*a* of FIG. 4*b*.
Figure 5B:
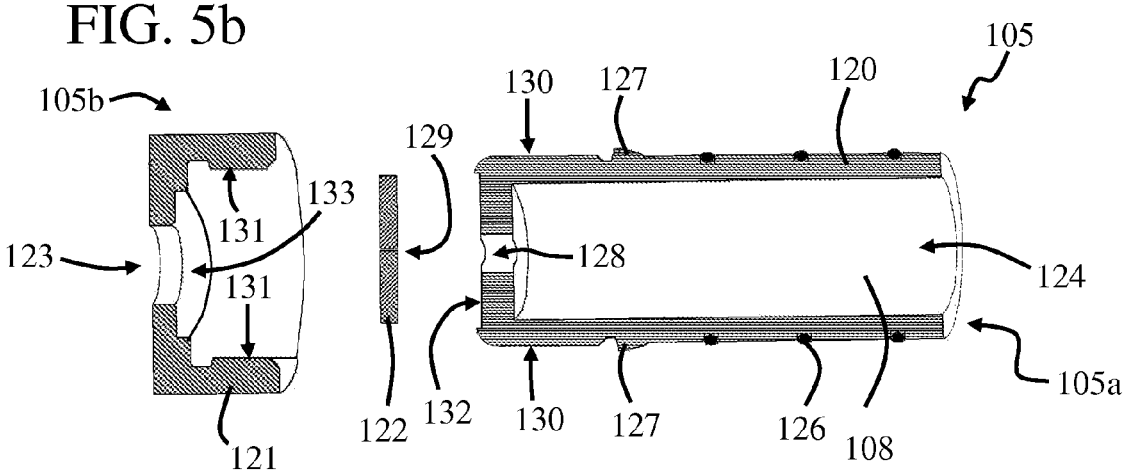
Figure 5C:
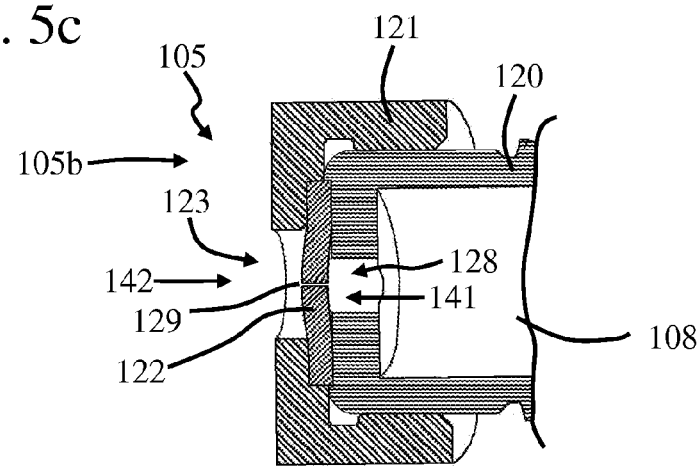

FIGS. 4*a* and 4*b* are front and back perspective views, respectively, of one embodiment of valve 105 and FIGS. 5*a*, 5*b* and 5*c* are cross-sectional view of valve 105 taken along a cut-line 5*a*-5*a* of FIG. 4*b*. In this embodiment, valve 105 includes a diaphragm 122 having an aperture 129 extending therethrough. Diaphragm 122 can include many different materials, but it generally includes an elastomeric material, such as rubber or plastic.

In this embodiment, valve 105 includes a hollow cylindrical tube 120, although tube 120 can have other shapes. Tube 120 includes opposed openings 124 and 128, wherein opening 124 has a larger dimension than opening 128. Openings 124 and 128 are positioned proximate to input and output ends 105*a* and 105*b*, respectively. In this embodiment, tube 120 extends through lug 102. In particular, tube 120 extends through lubricant chamber 106. In this embodiment, tube 120 extends through bit chamber 107 and lug 102.

In this embodiment, tube 120 includes recesses 125 (FIGS. 4*a* and 4*b*) which extend around its outer periphery and are for receiving sealing members 126 (FIGS. 5*a*-5*b*). Sealing member 126 provides a seal between valve 105 and lug 102. In particular, sealing member 126 provides a seal between the tube 120 and lug 102. Sealing members 126 can be of many different types, such as O-ring seals. Sealing members 126 engage the outer periphery of tube 120 with an inner surface lubricant chamber 106 (FIG. 3) and provide a seal therebetween. Tube 120 also includes a ridge 127 which extends around its outer periphery and is used to frictionally engage lug 102. Tube 120 includes threads 130 (FIG. 5*b*) which extend along its outer periphery proximate to distal end 105*b*.

In this embodiment, valve 105 includes a cap 121 with an opening 123 extending through it. Cap 121 is repeatably moveable between positions engaged with and disengaged from tube 120. Here, cap 121 includes threads 131 extending along its inner diameter so they can be threaded and unthreaded with threads 130. In this way, cap 121 and tube

120 can be engaged together and disengaged from each other in a repeatable manner. It should be noted, however, that cap 121 can be repeatably engaged with and disengaged from tube 120 in many other ways, such as with an adhesive.

In accordance with the invention, tube 120 and cap 121 include grooves 132 and 133 which extend around openings 128 and 123, respectively. Grooves 132 and 133 are shaped and dimensioned to receive diaphragm 122. Groove 133 opposes groove 132 when cap 121 is engaged with tube 120. In this way, diaphragm 122 can be positioned and held between tube 120 and cap 121 and held within grooves 132 and 133. Diaphragm 122 is held between cap 121 and tube 120 so that aperture 129 is in fluid communication with openings 123 and 128. It should be noted that tube 120, cap 121 and diaphragm 122 can be separate pieces or a single integrated piece, or combinations thereof. For example, tube 120 and cap 121 can be a single integrated piece with a slot to hold a replaceable diaphragm 122 (not shown).

In accordance with the invention, diaphragm 122 is allowed to flex in an outward direction 141 (FIG. 5*c*) through opening 123 and is restricted from flexing in an inward direction 142 through opening 128. When diaphragm 122 is moved in outward direction 141, aperture 129 moves from a closed condition to an open condition. Further, when diaphragm 122 is moved in inward direction 142, aperture 129 moves from its open condition to its closed condition. When aperture 129 is in its open condition, openings 123 and 128 are in fluid communication with each other and the lubricating material can flow from input end 105*a* to output end 105*b*. Further, when aperture 129 is in its closed condition, openings 123 and 128 are not in fluid communication with each other and the drilling fluid cannot flow from output end 105*b* to input end 105*a*.

The amount diaphragm 122 is allowed to flex and unflex depends on many different factors, such as the material it includes. For example, diaphragm 122 can flex more if it includes a more resilient material and diaphragm 122 can flex less if it includes a less resilient material. The amount diaphragm 122 is allowed to flex and unflex also depends on the dimensions of openings 123 and 128. Diaphragm 122 is allowed to flex in outward direction 141 more as the dimension of opening 123 increases. Further, diaphragm 122 is allowed to flex in outward direction 141 less as the dimension of opening 123 decreases. Diaphragm 122 is allowed to flex in inward direction 142 more as the dimension of opening 128 increases. Further, diaphragm 122 is allowed to flex in inward direction 142 less as the dimension of opening 128 decreases. As mentioned above, opening 124 has a larger dimension than opening 128 so that diaphragm 122 is allowed to flex more in outward direction 141 than in inward direction 142.

It should be noted that the movement of diaphragm 122 between its flexed and unflexed conditions depends on the pressure difference between the materials in valve cavity 108 and bit chamber 107. For example, as the pressure of the lubricating material in valve cavity 108 increases relative to the pressure of the drilling fluid in bit chamber 107, diaphragm 122 flexes in outward direction 141. When diaphragm 122 flexes enough for aperture 129 to move to its open condition, lubricant, bit chamber 107 and valve cavity 108 are in fluid communication with each other and the pressure difference between them is reduced. In one situation, when aperture 129 is in its open condition, the pressure difference between bit chamber 107 and valve cavity 108 is driven to be the threshold pressure value.

Further, as the pressure of the lubricating material in valve cavity 108 decreases relative to the pressure of the material in bit chamber 107, diaphragm 122 moves in inward direction 142 until it is unflexed. When diaphragm 122 is unflexed, aperture 129 is in its closed condition and bit chamber 107 and valve cavity 108 are not in fluid communication with each other. Further, the pressure difference between bit chamber 107 and valve cavity 108 is driven to a pressure value that is less than or equal to the threshold pressure value. In one situation, the pressure difference between bit chamber 107 and valve cavity 108 is equal to the threshold pressure value.

It should be noted that the threshold pressure value can be chosen in many different ways. For example, it can be chosen by choosing the material included with diaphragm 122. For example, the threshold pressure value needed to move aperture 129 from its closed condition to its open condition increases as the resiliency of the material included with diaphragm 122 decreases. Further, the threshold pressure value needed to move aperture 129 from its closed condition to its open condition decreases as the resiliency of the material included with diaphragm 122 increases.

It should be noted that, in some situations, diaphragm 122 is removed from between cap 121 and tube 120 by unthreading threads 130 and 131. Diaphragm 122 is then replaced with a replacement diaphragm which includes a material with a different resiliency than diaphragm 122. The threshold pressure value of valve 105 is increased and decreased if the replacement diaphragm includes less and more resilient material, respectively, than the material included with diaphragm 122. The replacement diaphragm is held between tube 120 and cap 121 by threadingly engaging threads 130 and 131 together. In this way, the threshold pressure value of valve 105 is chosen.

The threshold pressure value can also be chosen by choosing the dimensions of openings 123 and 128. The threshold pressure value decreases as the dimension of opening 128 is driven to equal the dimension of opening 123. Further, the threshold pressure value increases as the dimension of opening 128 is driven to be smaller than the dimension of opening 123.

It should be noted that, in some situations, cap 121 is removed from tube 120 by unthreading threads 130 and 131. Cap 121 is then replaced with a replacement cap which includes an opening with a dimension different from opening 123. The threshold pressure value of valve 105 is increased and decreased if the replacement cap includes a smaller and larger dimensioned opening, respectively. The replacement cap is attached to tube 120 by threadingly engaging threads 130 and 131 together. In this way, the threshold pressure value of valve 105 is chosen.

The threshold pressure value of valve 105 can also be chosen by choosing the size, shape and number of apertures 129 included with diaphragm 122. However, aperture 129 is sized and shaped to be open and closed when diaphragm 122 is in the flexed and unflexed conditions, respectively. Aperture 129 is generally a single circular opening, but can be a slit or a plurality of circular openings and/or slits. As the dimension of aperture 129 increases, the threshold pressure value of valve 105 decreases. Further, as the dimension of aperture 129 decreases, the threshold pressure value of valve 105 increases. As the number of aperture(s) 129 increases, the threshold pressure value of valve 105 decreases. Further, as the number of aperture(s) 129 decreases, the threshold pressure value of valve 105 increases.

Figure 6:
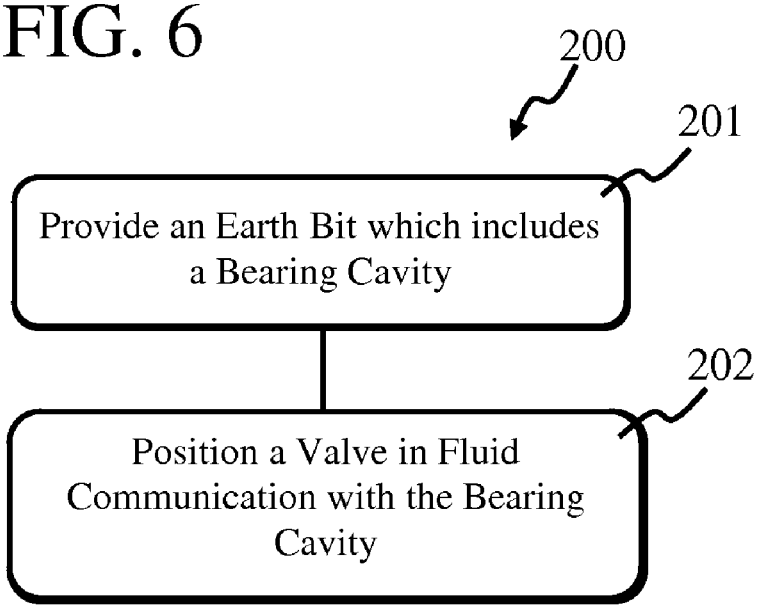
FIG. 6 is a flow diagram of a method of assembling an earth bit with a valve, in accordance with the invention.

FIG. 6 is a flow diagram of a method 200 of assembling an earth bit, in accordance with the invention. In this embodiment, method 200 includes a step 201 of providing an earth bit which includes a bearing cavity for holding a lubricating material. The lubricating material is used to lubricate the components of the earth bit, such as a cutting cone and bearing journal. Method 200 includes a step 202 of positioning a valve so that its input end is in fluid communication with the bearing cavity and its output end is in fluid communication with a bit chamber.

In accordance with the invention, the valve operates as a one-way valve which allows the flow of the lubricating material from the input end to the output end of the valve. The valve restricts the flow of a drilling fluid from the output end to the input end. As discussed in more detail above, the drilling fluid flows through a bit chamber. The valve allows the flow of the lubricating material from the input end to the output end in response to the pressure of the lubricating material being above the threshold pressure value relative to the pressure of the drilling fluid. The valve restricts the flow of the drilling fluid from the output end to the input end.

In one embodiment, the valve includes a diaphragm which is repeatably moveable between flexed and unflexed conditions. The diaphragm includes an aperture which is repeatably moveable between open and closed conditions in response to the diaphragm being flexed and unflexed. When the aperture is in its open condition, the bearing cavity is in fluid communication with the bit chamber. When the aperture is in its closed condition, the bearing cavity is not in fluid communication with the bit chamber.

Figure 7:
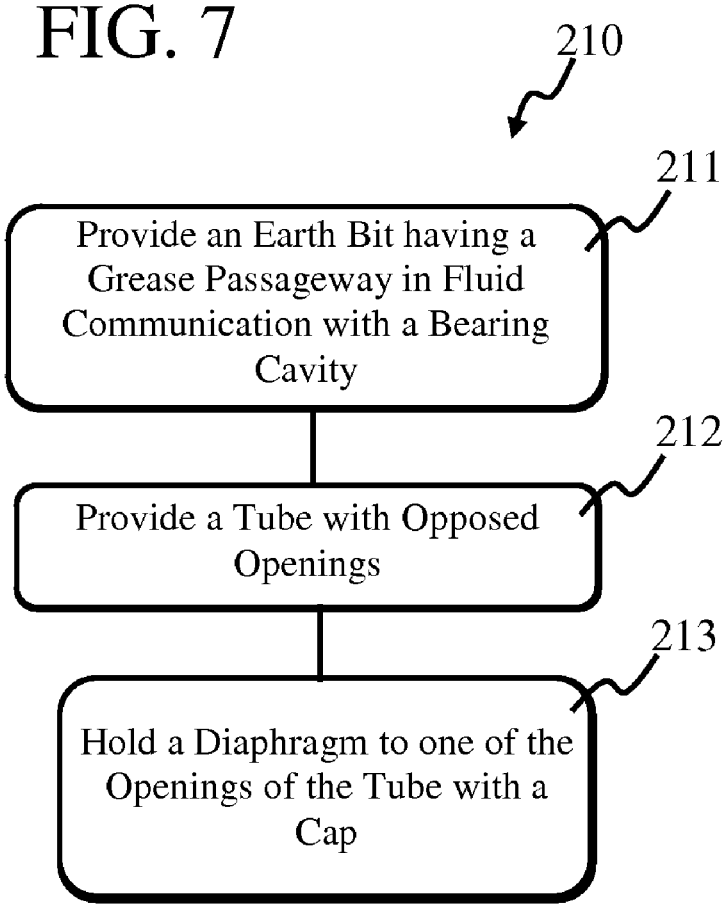
FIG. 7 is a flow diagram of a method of manufacturing an earth bit with a valve, in accordance with the invention.

FIG. 7 is a flow diagram of a method 210 of manufacturing an earth bit, in accordance with the invention. In this embodiment, method 210 includes a step 211 of providing an earth bit having a grease passageway in fluid communication with a bearing cavity. Method 210 includes a step 212 of providing a tube with opposed openings, wherein one of the openings is in fluid communication with the grease passageway. Method 210 includes a step 213 of holding a diaphragm to the other opening of the tube with a cap. The diaphragm includes an aperture and is repeatably moveable between flexed and unflexed conditions. The aperture is repeatably moveable between open and closed conditions in response to the flexing and unflexing of the diaphragm.

In accordance with the invention, the diaphragm, tube and cap operate as a one-way valve which allows the flow of the lubricating material out of the lubricating chamber and restricts the flow of drilling fluid into the bearing cavity. The diaphragm allows the flow of the lubricating material through the tube and out of the bearing cavity in response to the pressure of the lubricating material being above a threshold pressure value relative to the pressure of the drilling fluid. The diaphragm restricts the flow of the drilling fluid through the tube and into to bearing cavity.

While particular embodiments of the invention have been shown and described, numerous variations and alternate embodiments will occur to those skilled in the art. Accordingly, it is intended that the invention be limited only in terms of the appended claims.

The invention claimed is:

1. An earth bit, comprising:

first and second lugs coupled together to form an internal bit chamber, wherein the first lug includes a lubricant chamber in fluid communication with a bearing cavity; and a valve in fluid communication with the lubricant chamber, the valve being engaged with the first lug and including a diaphragm with an aperture, wherein the aperture is repeatably moveable between open and closed conditions in response to the pressure of a material in the lubricant chamber;

wherein the valve includes input and output ends which extend through the lubricant and internal bit chambers, respectively; and wherein the diaphragm is held to a tube with a cap.

2. The earth bit of claim 1, wherein the diaphragm is repeatably moveable between flexed and unflexed conditions in response to the pressure.

3. The earth bit of claim 2, wherein the diaphragm moves towards and away from the bit chamber in response to moving between the flexed and unflexed conditions, respectively.

4. The earth bit of claim 1, wherein the diaphragm is allowed to flex in one direction and restricted from flexing in another direction.

5. The earth bit of claim 1, wherein the amount of pressure needed to move the aperture to its open condition depends on the material included with the diaphragm.

6. The earth bit of claim 1, wherein the amount of pressure needed to move the aperture to its open condition depends on the amount the diaphragm is allowed to flex.

7. The earth bit of claim 1, wherein the lubricant chamber is in fluid communication with the bit chamber through a valve cavity of the valve in response to the aperture being in the open condition.

8. The earth bit of claim 1, wherein the tube extends through the bit and lubricant chambers.

9. The earth bit of claim 1, wherein the diaphragm extends through the bit chamber.

10. The earth bit of claim 1, wherein the output end of the valve extends through the bit chamber.

11. The earth bit of claim 1, wherein the material flows from the lubricant chamber to the bit chamber in response to the aperture moving to the open condition.

12. The earth bit of claim 1, wherein the valve extends through the lug.

13. The earth bit of claim 1, wherein the valve extends through a shoulder of the lug.

14. The earth bit of claim 13, wherein the input and output ends are on opposed sides of the shoulder.

15. The earth bit of claim 13, wherein the shoulder extends through the internal bit chamber.

16. The earth bit of claim 1, wherein the tube extends through the bit chamber and lug.

17. The earth bit of claim 16, wherein the tube extends through the lubricant chamber.

18. The earth bit of claim 1, wherein the input end of the valve extends through the lug.

19. The earth bit of claim 1, wherein the valve extends through an internal shoulder of the lug.

20. An earth bit, comprising:

a plurality of lugs coupled together to form an internal bit chamber, wherein each lug includes a lubricant chamber extending therethrough; and a valve having an input end facing the lubricant chamber of one of the lugs, and an output end facing the bit chamber, wherein the valve extends through the lubricant chamber and engages the corresponding lug; and wherein the valve has a diaphragm held to a tube with a cap.

21. The earth bit of claim 20, wherein the diaphragm includes an aperture, the aperture being repeatably moveable between open and closed conditions in response to the pressure of a material in the lubricant chamber.

22. The earth bit of claim 20, wherein the lubricant chamber is in fluid communication with the bit chamber through a valve cavity of the valve in response to an aperture of the valve being in the open condition.

23. The earth bit of claim 20, wherein the cap is positioned proximate to the output end of the valve.

24. The earth bit of claim 20, wherein the output end of the valve extends through the bit chamber, and the input end extends through the lubricant chamber.

25. The earth bit of claim 20, wherein the diaphragm moves towards the bit chamber in response to moving from the unflexed condition to the flexed condition.

26. The earth bit of claim 25, wherein the diaphragm moves away from the bit chamber in response to moving from the flexed condition to the unflexed condition.

27. The earth bit of claim 20, wherein the valve extends through the lug.

28. The earth bit of claim 20, wherein the valve extends through a lubricant chamber opening of the lug.

29. The earth bit of claim 28, wherein the lubricant chamber extends between a bearing cavity and the lubricant chamber opening of the lug.

30. The earth bit of claim 28, wherein the lubricant chamber opening extends through a shoulder of the lug.

31. The earth bit of claim 30, wherein the shoulder extends through the bit chamber.

32. An earth bit, comprising:

a cutting cone;

a lug adjacent to an internal bit chamber, the lug including a lubricant chamber extending therethrough, wherein the cutting cone is rotatably mounted to the lug; and a valve having a diaphragm held to a tube with a cap, wherein the cap extends through the bit chamber and wherein the tube extends through the lubricant chamber and engages the lug.

33. The earth bit of claim 32, wherein input and output ends of the valve extend through the lubricant chamber and bit chamber, respectively.

34. The earth bit of claim 32, wherein the diaphragm includes an aperture which is repeatably moveable between open and closed conditions in response to the pressure of a material in the lubricant chamber.

35. The earth bit of claim 34, wherein the material flows from the lubricant chamber to the bit chamber in response to the aperture moving to the open condition.

36. The earth bit of claim 35, wherein the lubricant chamber is in fluid communication with the bit chamber through the tube in response to the aperture being in the open condition.

37. The earth bit of claim 32, wherein the diaphragm moves towards and away from the bit chamber in response to moving between the flexed and unflexed conditions, respectively.

38. The earth bit of claim 32, wherein the diaphragm moves towards and away from an opening of the cap in response to moving between the flexed and unflexed conditions, respectively.

39. The earth bit of claim 38, wherein the opening of the cap faces the bit chamber.

40. The earth bit of claim 32, further including a sealing member which extends around the outer periphery of the tube and engages the inner surface of the lubricant chamber.

41. The earth bit of claim 32, wherein the tube extends through the lug.

42. The earth bit of claim 32, further including a sealing member which provides a seal between the valve and lug.

43. The earth bit of claim 42, wherein the sealing member is an O-ring seal.

44. The earth bit of claim 32, further including a sealing member which provides a seal between the tube and lug.

45. The earth bit of claim 44, wherein the tube includes a recess, and the sealing member extends through the recess.

46. An earth bit, comprising:

a plurality of lugs coupled together to form an internal bit chamber, wherein each lug includes a lubricant chamber extending therethrough; and a valve which includes a diaphragm held to a tube with a cap, wherein the valve engages one of the lugs;

wherein the lug engaged by the valve includes a shoulder which extends through the internal bit chamber, and the valve extends through the shoulder.

47. The earth bit of claim 46, wherein the lug includes a lubricant chamber opening through which the valve extends.

48. The earth bit of claim 46, wherein the tube engages the lug.

49. The earth bit of claim 48, wherein the lubricant chamber extends between a bearing cavity and the lubricant chamber opening of the lug engaged by the valve.

50. The earth bit of claim 49, wherein the bearing cavity is formed between the lug engaged by the valve and a cutting cone.

51. The earth bit of claim 50, wherein the tube extends through the lubricant chamber opening.

* * * * *